US005178283A

United States Patent [19]

Ennis

[11] Patent Number: 5,178,283

[45] Date of Patent: Jan. 12, 1993

[54] SECURE GLASS DISPLAY

[76] Inventor: Jan S. Ennis, 16709 NE. 41st St., Redmond, Wash. 98052

[21] Appl. No.: 642,300

[22] Filed: Jan. 17, 1991

Related U.S. Application Data

[63] Continuation-in-part of Ser. No. 232,303, Nov. 12, 1988, abandoned.

[51] Int. Cl.[5] ..... A47F 5/00

[52] U.S. Cl. ..... 211/4; 211/13; 248/902

[58] Field of Search ..... 211/4, 13, 89, 82; 248/551, 902

[56] References Cited

U.S. PATENT DOCUMENTS

| | | | |
|---|---|---|---|
| 319,293 | 6/1885 | Merritt | 248/902 X |
| 595,253 | 12/1897 | Sankey | 211/4 |
| 614,933 | 11/1898 | Christianus | 211/8 |
| 1,661,516 | 3/1928 | Vineberg | 211/4 |
| 2,884,219 | 4/1959 | Glover | 248/902 X |
| 4,128,224 | 12/1978 | Guichard | 248/902 X |
| 4,558,788 | 12/1985 | Grothaus | 248/902 X |
| 4,695,026 | 9/1987 | Medley, Jr. | 248/902 X |
| 4,878,641 | 11/1989 | Vogt | 248/902 X |

FOREIGN PATENT DOCUMENTS

| | | | |
|---|---|---|---|
| 2024003 | 1/1980 | United Kingdom | 211/4 |

*Primary Examiner*—Karen J. Chotkowski

[57] ABSTRACT

A spectacle display device including security comprising a stand (2,6), a nosepiece (6), a security member (10) released by key (12).

3 Claims, 4 Drawing Sheets

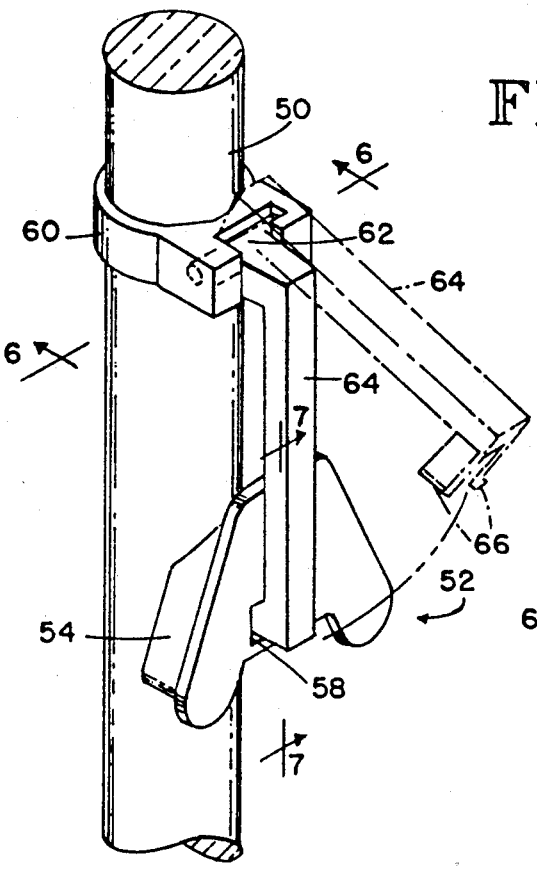
FIG. 5
FIG. 6
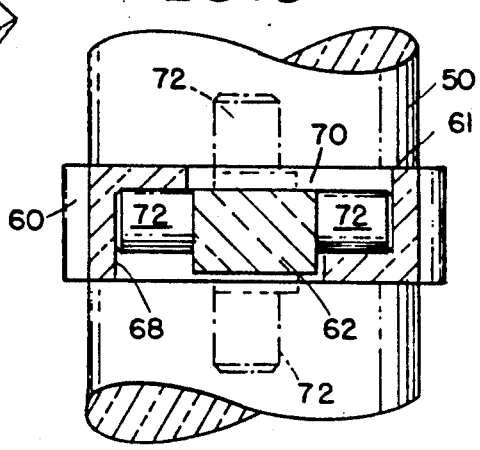
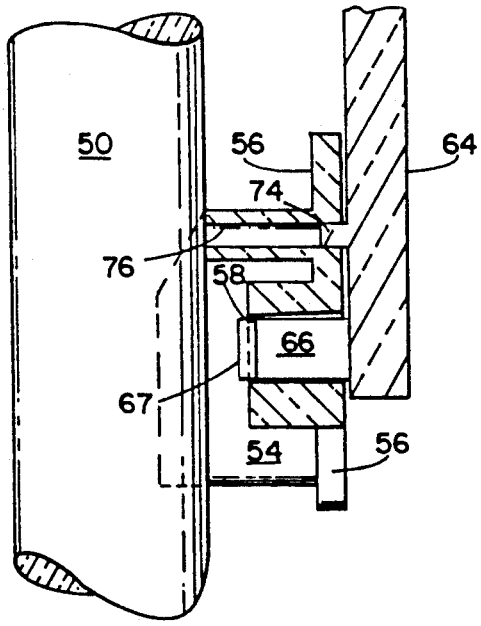
FIG. 7
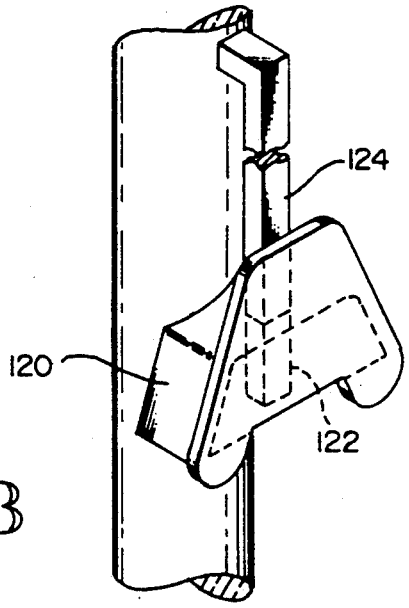
FIG. 13

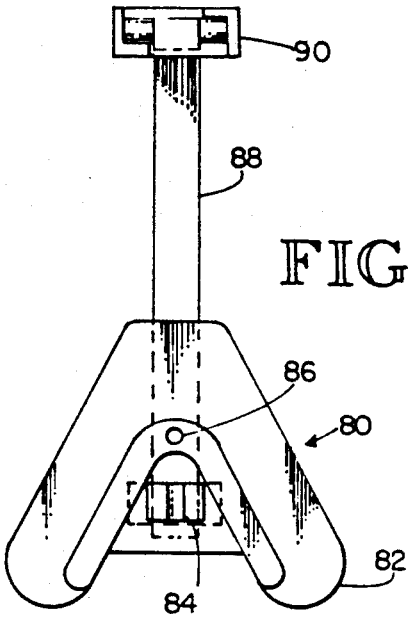
FIG. 8
FIG. 12
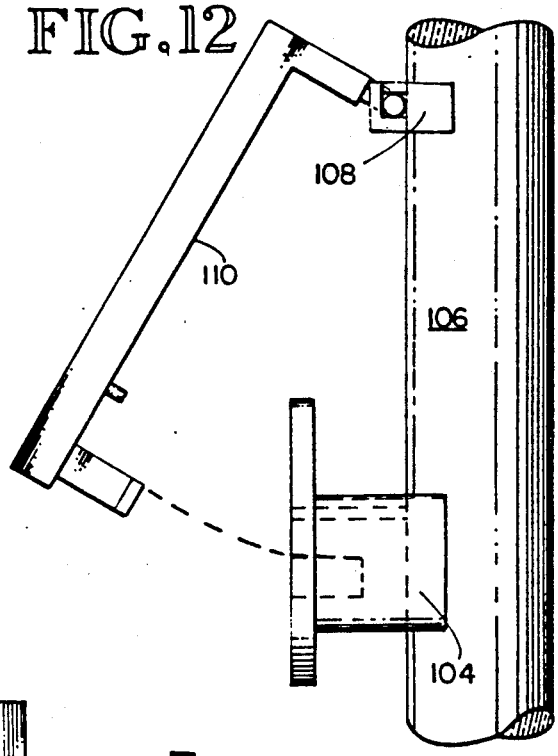
FIG. 9
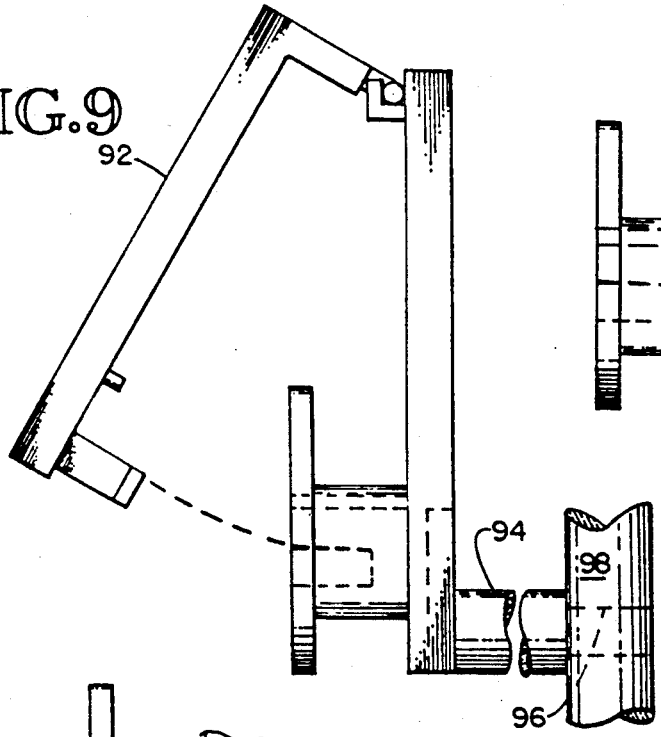
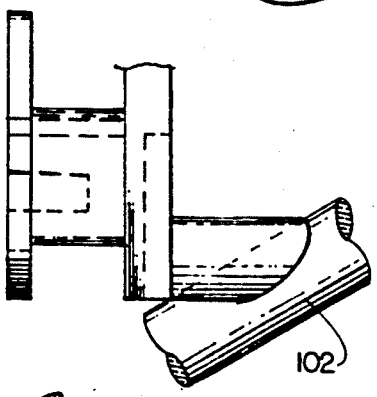
FIG. 11
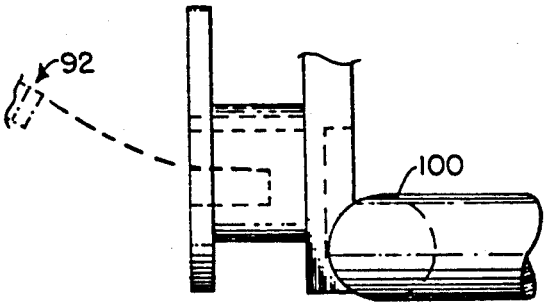
FIG. 10

SECURE GLASS DISPLAY

BACKGROUND OF THE INVENTION

This application is a continuation-in-part of U.S. patent application Ser. No. 232,303, filed Nov. 12, 1988, now abandoned.

TECHNICAL FIELD

This invention is directed toward the convenient display of eyeglass frames and lenses and in particular to display devices which do not place a barrier between the customer and the frames but include integral security devices.

It is well known and accepted that appearance is of great importance with respect to the utilization of eyeglasses, whether for corrective lenses or for eye protection, i.e. sunglasses.

As the quality of the frames and/or lens inserts have increased, likewise so have their prices, making the ready to wear devices prime subject matter for thieves. To reduce the amount of pilferage, shop owners have taken to the procedure of displaying their eyeglasses in glass enclosed, locked cases. This approach not only greatly increases the overhead, but also presents a requirement that a salesperson be readily available to service the display to allow a prospective customer to look at and try on a designer set of eyeglasses.

With the above noted facts in mind, it is an object of the present invention to provide an attractive, simple and inexpensive eyeglass display device wherein the displayer can easily control the access to the glasses.

It is another object of the present invention to provide an eyeglass display device wherein the shop holder has a choice of either utilizing an inexpensive display device without security or as an option, with the same display device, provide simple and inexpensive security.

Yet still another object of the present invention, is to adapt a known glass frame display system to a secure display system through the utilization of a simple and yet effective device which securely and selectively controls access to the frame.

It is still another object of the present invention to provide a security device wherein the actual device is simple and straight forward, inexpensive to manufacture and the key likewise is simple, straight forward and inexpensive to manufacture.

Yet another object of the present invention is to provide a vertical support for glass frames or the like wherein a second element is secured to a vertical post above the nosepiece and includes a hingedly mounted member for interacting with the nosepiece and locking the frame to the nosepiece.

Still a further object of the present invention is to provide a security device for a glasses frame display piece wherein a locking element, which prevents removal of the frame, is snapped into position in a frame supporting element and cannot be removed without the utilization of a specially designed tool.

BRIEF DESCRIPTION OF THE DRAWINGS

FIG. 5 is a pictorial representation of an alternate embodiment of the present invention including a second fastening point.

FIG. 6 is a sectional view along lines 6—6 of FIG. 5.

FIG. 7 is a sectional view along lines 7—7 of FIG. 5.

FIG. 8 is yet a third alternate embodiment of the present invention.

FIG. 9 is a side elevational view of the devices of FIG. 8.

FIGS. 10 and 11 are alternate fastening means.

FIG. 12 is a fourth alternate embodiment of the present invention.

FIG. 13 is a fifth alternate embodiment of the present invention.

BEST MODE FOR CARRYING OUT THE INVENTION

Figure 1:
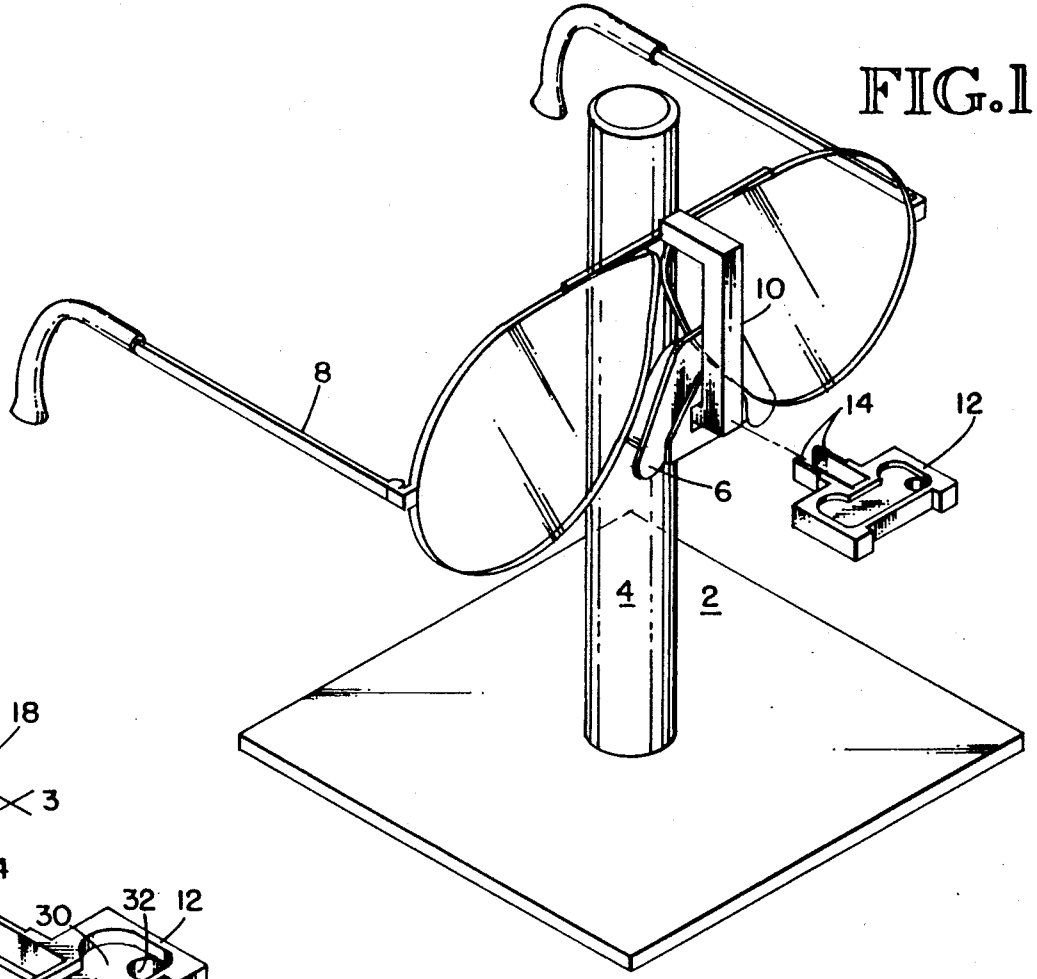
FIG. 1 is a pictorial representation of a display device for a single pair of glasses depicting the preferred support system and the security device.

As depicted in FIG. 1, the present invention is shown secured to a display unit for a single pair of glasses having a base 2, solid cylindrical upright member 4, a nosepiece 6, supporting a pair of glasses 8, mounted in a frame and an essentially rectangular security device 10, which, as explained hereinafter is lockingly held onto the nosepiece 6, and extends upwardly over the top of the frame 8, preventing unauthorized removal of the displayed glasses.

Likewise depicted in FIG. 1, is the inventive key device which, for reasons to be explained hereinafter, includes a broad, relatively flat handle portion 12 and a pair of outwardly projecting thin flexible legs 14.

Figure 2:
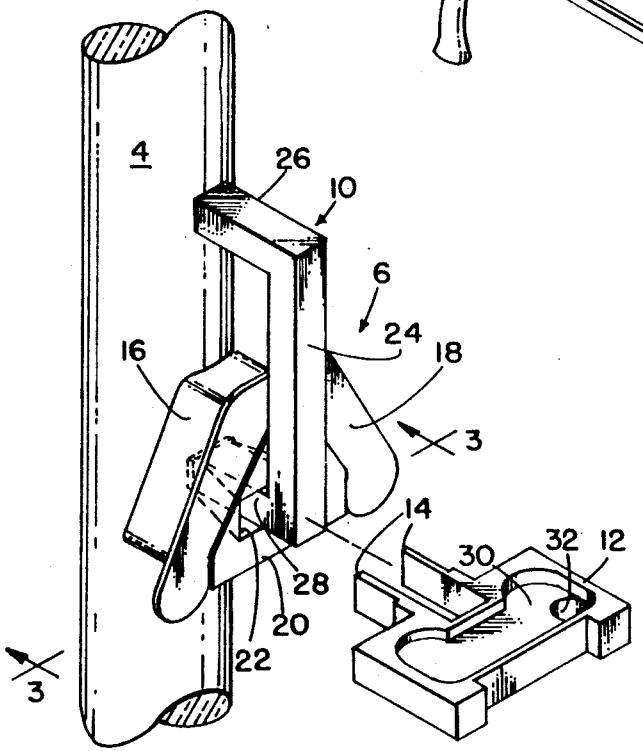
FIG. 2 is an enlarged view of the support and security system of FIG. 1 with the eyeglasses removed.

Reference is now had to FIG. 2 where it can be seen that the vertical cylindrical display stand 4 supports the nosepiece 6, which includes, as an integral portion thereof, a bridge member 16, and a front face plate member 18, such that, with or without the security device as described hereinafter, a pair of glasses can be set upon the display device for easy visualization and close inspection by the prospective customer.

In the present, preferred embodiment, the lower portion of the bridge member 6, has been fabricated from a solid piece 20, which includes a central rectangular bore 22 which, as can be seen in phantom in this view and explained in greater detail hereinafter, has inwardly and rearwardly tapered sides.

The security device which holds the glasses in position on the support is depicted as a squared, U-shaped device having a base 24, of sufficient dimension to extend from the bore in the nosepiece upwardly to clear the upper external dimension of the frame. The U-shaped device 10, likewise includes a pair of outwardly extending substantially parallel legs 26 and 28, such that when the security device is locked in position, it forms a closed loop with the vertical support 4.

The unlocking or key member having a body 12 and legs 14 can best be seen in FIG. 2 and as seen in this view, the body 12 includes an indentation 30, a bore 32 and the legs 14 are stepped such that the outer end is thin enough to flex following the sidewall when moved forward into opening 22.

Figure 3:
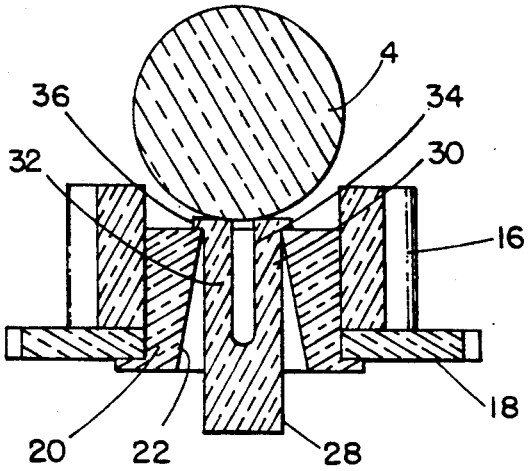
FIG. 3 is a sectional view along lines 3—3 of FIG. 2 with the security device in place.

Referring now to FIG. 3, it can be seen that when in locked position, the lower leg 28 of the locking U 10 is bifurcated and includes 2 parallel legs 30, 32 separated by a slot and including outwardly extending feet members 34, 36 such that when the leg is forced inwardly along the tapered sides of opening 22 the legs are forced inwardly until they pass the inner edge of element 20 and snap outwardly holding the device in position until the legs are again compressed.

Figure 4:
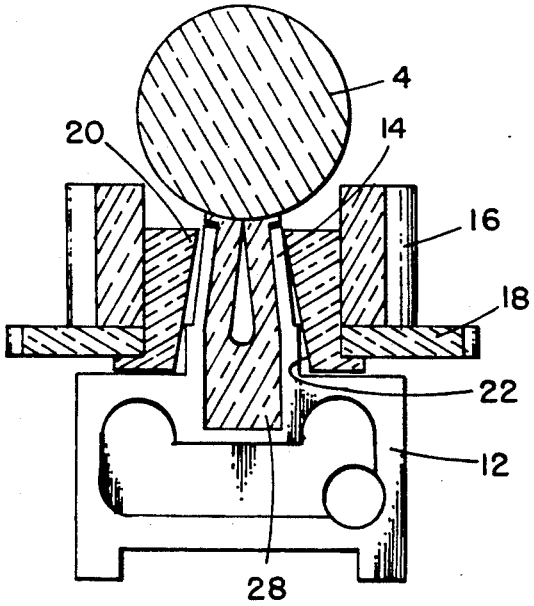
FIG. 4 is a view identical with FIG. 3 with the key inserted moving the security device to an unlocked position.

Referring now to FIG. 4, to remove the security device, the key is placed in a position straddling the security device and moved forwardly such that the legs of the key bend the legs of the security device inwardly. The legs of the key are of sufficient thickness that they move the feet towards each other, neutralizing the locking effect generated by the feet allowing the security device to be easily removed.

It is to be understood that for greater security additional interactive mechanical devices may be used in conjunction with the security device and the vertical support such as male/female interlocking or interacting members preventing undesired lateral movement of the locking member.

The second embodiment of the present invention is best seen in FIG. 5, wherein a vertical member 50, which can support one or more of the secure display devices, is shown having a nosepiece 52 having a main body portion 54 to support the bridge of an eye glass frame, with or without the lenses, and a forward, outwardly projecting flange 56 to retain the frame in position between the support 50 and the flange 56 as well as a horizontal bore 58, all substantially as described with respect to the previous embodiment.

At a predetermined distance above the nosepiece 52 there is supplied an encircling ring member 60 having a forwardly projecting block member including a pair of opposing slots, as described hereinafter, to receive trunion like member 62 located at the upper inner end of latch member 64. Latch member 64 includes a pair of flexible projecting legs (not shown) similar to that shown in the previous embodiment such that the latch member 64 may be pivoted upwardly, as shown in phantom, to allow removal of the eye glass frame or pivoted downwardly to the latched position, preventing removal of the frame. In the phantom view, the legs 66 may be seen.

Thus, as can be seen, the utilization of a simple extractor, as described hereinabove to move the latching legs inwardly to clear the edges of the opening 58 allows the latching mechanism 64 to be pivoted upwardly about trunion 62 permitting removal of the glass frame.

Reference is now had to FIG. 6, wherein the vertical cylindrical post 50 is shown along with the encircling band 60 and a section through the forward extension 61 which illustrates that the forward extension 61 includes an opening which is open downwardly as at 68 to the left and upwardly as at 70 to the right such that the trunion like members 72 can be moved into operating position by first placing them in a vertical orientation, as shown in phantom, and then rotating them clockwise to the operational position as shown in solid.

It is to be understood that since the trunion like member 72 is integral with the upper end portion 62 of securement member 64, once in position, as shown in solid in FIG. 6, allows vertical rotation of securement member 64 while preventing removal when securement member 64 is in the downward or latched position.

Reference is now had to FIG. 7 wherein it can be seen that the outwardly projecting ears 66 of securement member 64 are inserted into opening 58 and by means of laterally extending latch member 67 are secured in place as explained hereinabove. Also to be seen in this view is a horizontally projecting male member 74 which is an integral element with latch member 64 and projects into horizontal opening 76 within nosepiece 54 further insuring the stability of latch member 64.

As seen in FIG. 8, the securement device can be made as a single piece wherein the nosepiece 80 including the flange 82, opening 84 and pin receiving member 86 also includes an upstanding rigid element 88 having formed thereupon the trunion receiving member 90.

FIG. 9, which is a side elevational view of the device of FIG. 8, including the locking mechanism 92 further includes a rearwardly projecting post 94 for insertion into a hole 96 in a piece of sheet stock or the like 98.

FIG. 10 illustrates how the device of FIG. 8 could be mounted upon a horizonal rod 100.

FIG. 11 depicts the device of FIG. 8 as secured to an angled rod or other support mechanism 102.

Reference is now had to FIG. 12, wherein another embodiment is shown wherein the nasal piece 104 is mounted to the edge of a piece of flat stock 106 as is the hinging member 108 which supports the locking member 110.

Thus as can be seen, the present invention contemplates a simple, easy to use method of displaying and security eyeglasses or the like and yet allows a rapid and easy removal for demonstration to the customer.

FIG. 13 illustrates yet another embodiment of the present invention wherein the nosepiece 120 includes a vertically oriented rectangular bove 122 for receiving the lower portion of leg 124 of the security member which, as hereinabove described, includes a bifurcated end permitting it to be snapped into position and then selectively removed utilizing a specially designed tool or key.

I claim:

1. A secure spectacle display device comprising:

a relatively fixed main support element including at least one nosepiece for supporting a pair of spectacles, a securement device extending from the nosepiece to the main support element, overlying a pair of spectacles located on the nosepiece and preventing removal thereof, said securement device being of rigid material of a wide U-configuration sufficient to extend over the bridge of the spectacles with two relatively short legs, and having the outer end of at least one of the legs bifurcated and including outwardly projecting feet such that, when the leg is inserted into a mating receptacle adjacent the pair of spectacles, the feet will lock it in place, restraining the pair of spectacles until the bifurcated portion is compressed to release the securement device thereby releasing the pair of spectacles.

2. A display fixture for spectacles wherein the spectacles are locked to the fixture, but may be individually released comprising:

a relatively fixed base member including at least one spectacle supporting nosepiece, securement means releasably locked to the base member, capturing a spectacle located upon the nosepiece, said securement means extending over the bridge of the spectacle and including a bifurcated end portion which is snapped into a mating opening in an element secured to the base member.

3. A device which permits display of spectacles and simultaneously selectively prevents removal of them, comprising:

relatively fixed support means, at least one nose piece mounted upon the support means, and, securement means having a bifurcated end selectively and releasably secured to the support means overlying and securing a pair of spectacles resting on the nosepiece, said securement means moved in a horizontal direction to mate with means secured to the support means to prevent removal of the spectacles and upon release allowing removal of the spectacles, said bifurcated end compressed when mated and released.

* * * * *